US009119993B2

(12) United States Patent
Fellini et al.

(10) Patent No.: US 9,119,993 B2
(45) Date of Patent: Sep. 1, 2015

(54) TENNIS RACKET HAVING AN OPTIMIZED STRIKING AREA

(75) Inventors: Scott R. Fellini, Lyndhurst, NJ (US); Anthony Rosso, Lincroft, NJ (US); Joseph J. Hodges, Jr., Jamaica, NY (US); Marisa Hodges, legal representative, West Babylon, NY (US)

(73) Assignee: OJOEE Industries, Inc., Glen Rock, NJ (US)

( * ) Notice: Subject to any disclaimer, the term of this patent is extended or adjusted under 35 U.S.C. 154(b) by 0 days.

(21) Appl. No.: 13/592,903

(22) Filed: Aug. 23, 2012
(Under 37 CFR 1.47)

(65) Prior Publication Data

US 2013/0231204 A1 Sep. 5, 2013

Related U.S. Application Data

(60) Provisional application No. 61/526,684, filed on Aug. 24, 2011.

(51) Int. Cl.
*A63B 59/00* (2015.01)
*A63B 49/02* (2015.01)
*A63B 47/02* (2006.01)

(52) U.S. Cl.
CPC ..... *A63B 49/02* (2013.01); *A63B 47/02* (2013.01); *A63B 2049/0229* (2013.01); *A63B 2209/10* (2013.01)

(58) Field of Classification Search
CPC ..... A63B 59/00
USPC ..... 473/517
See application file for complete search history.

(56) References Cited

U.S. PATENT DOCUMENTS

| | | | | | |
|---|---|---|---|---|---|
| 1,038,264 | A | | 9/1912 | Baker | |
| 2,109,525 | A | * | 3/1938 | Donisthorpe | 473/547 |
| 2,132,780 | A | * | 10/1938 | Davis | 473/547 |
| 2,593,714 | A | * | 4/1952 | Robinson | 156/156 |
| 2,878,020 | A | * | 3/1959 | Robinson | 473/535 |
| 3,755,037 | A | * | 8/1973 | Erwin et al. | 156/185 |

(Continued)

FOREIGN PATENT DOCUMENTS

| | | |
|---|---|---|
| EP | 1208877 A1 | 5/2002 |
| FR | 2539633 A1 | 7/1984 |

(Continued)

OTHER PUBLICATIONS

International Search Report and Written Opinion; International Application No. PCT/US2012/52060; dated Nov. 26, 2012; 10 Pages.

(Continued)

*Primary Examiner* — Michael Dennis
*Assistant Examiner* — Dolores Collins
(74) *Attorney, Agent, or Firm* — Charney IP Law LLC

(57) ABSTRACT

A tennis racket having an optimized striking area and a ball collection portion. The tennis racket includes a handle, an oval frame attached to the handle, the oval frame including a U-shaped indentation, a plurality of vertical and horizontal strings attached to the oval frame, and a replaceable clip, wherein the plurality of vertical and horizontal strings form a sweet spot area, the sweet spot area having a size, and wherein a depth of the U-shaped indentation affects the size of the sweet spot area. The tennis racket may include one or more bars attached to the oval frame to further manage the sweet spot area.

16 Claims, 8 Drawing Sheets

(56) References Cited

U.S. PATENT DOCUMENTS

| | | | | | |
|---|---|---|---|---|---|
| 3,930,920 | A | * | 1/1976 | Kicherer | 156/156 |
| 3,968,875 | A | * | 7/1976 | Koehnle | 206/315.9 |
| 4,123,054 | A | * | 10/1978 | Septier | 473/536 |
| 4,798,382 | A | * | 1/1989 | Janes | 473/535 |
| 4,858,928 | A | * | 8/1989 | Muroi et al. | 473/519 |
| 4,861,029 | A | | 8/1989 | Takatsuka | |
| 4,930,778 | A | * | 6/1990 | Mizuno | 473/540 |
| 5,009,422 | A | * | 4/1991 | Soong | 473/535 |
| 5,174,568 | A | * | 12/1992 | You | 473/521 |
| 5,286,021 | A | * | 2/1994 | Shaw | 473/437 |
| D355,232 | S | | 2/1995 | Hodges | |
| 5,386,991 | A | * | 2/1995 | Rochette | 473/540 |
| D367,904 | S | * | 3/1996 | Hodges | D21/730 |
| 6,344,006 | B1 | | 2/2002 | Brandt | |
| 6,506,133 | B1 | * | 1/2003 | Hong | 473/539 |
| D498,278 | S | | 11/2004 | D'Agostino | |
| 7,112,153 | B1 | | 9/2006 | Beu | |
| 7,140,986 | B2 | | 11/2006 | Howe | |
| 7,309,299 | B2 | * | 12/2007 | Pezzato et al. | 473/540 |
| 7,871,343 | B2 | | 1/2011 | Blades | |
| 2002/0142869 | A1 | | 10/2002 | Nevers | |
| 2006/0084531 | A1 | | 4/2006 | Brandt | |
| 2007/0111830 | A1 | | 5/2007 | Wright | |
| 2010/0285908 | A1 | | 11/2010 | Chang | |

FOREIGN PATENT DOCUMENTS

| | | | |
|---|---|---|---|
| GB | 799947 | A | 8/1958 |
| JP | 3051064 | A | 3/1991 |
| WO | 8500114 | A1 | 1/1985 |
| WO | WO 2007057743 | | 5/2007 |

OTHER PUBLICATIONS

Supplementary European Search Report dated Mar. 19, 2015.

* cited by examiner

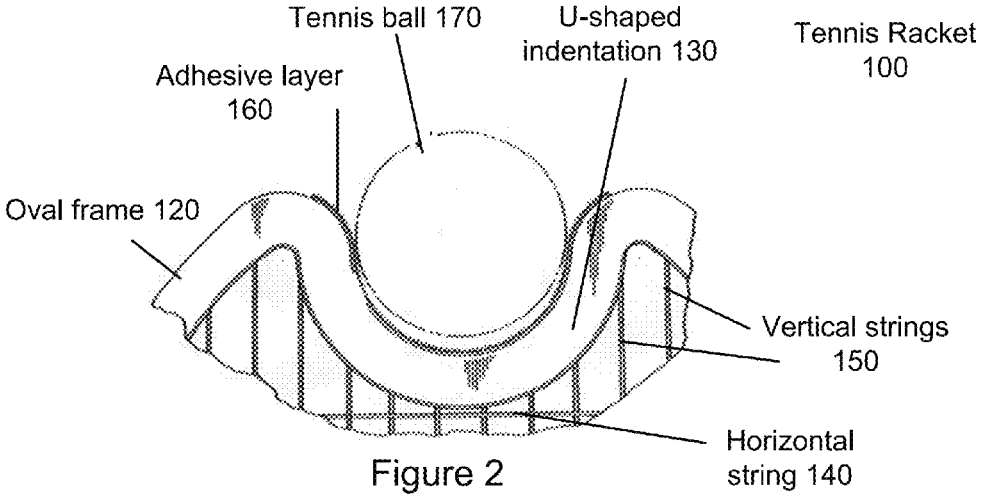
Figure 2 (close-up view)
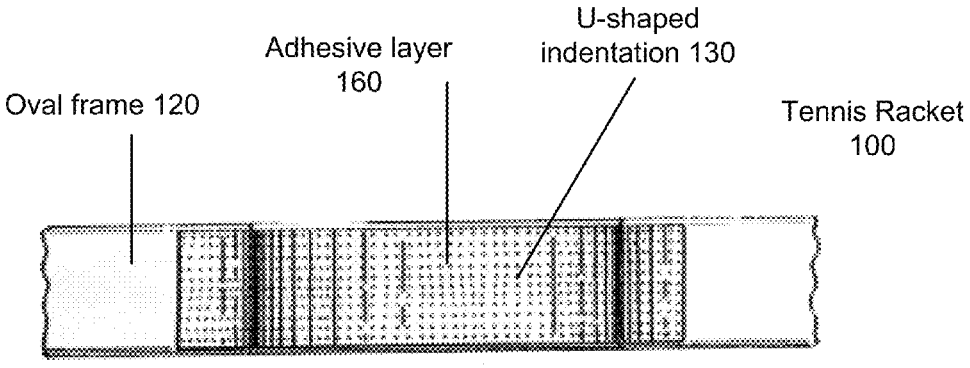
Figure 3 (top view)

(cross-
section side
view)

(top view)

(side view)

(bottom
view)

TENNIS RACKET HAVING AN OPTIMIZED STRIKING AREA

CROSS-REFERENCE TO RELATED APPLICATIONS

The present application claims the benefit, pursuant to the provisions of 35 U.S.C. 119, of U.S. Provisional Application Ser. No. 61/526,684, titled "Ball Collection/Maximum Performance String Striking Area Tennis Racket", filed on Aug. 24, 2011, which is herein incorporated by reference.

TECHNICAL FIELD

The present invention relates generally to a tennis racket, and more specifically, to a tennis racket having an optimized striking area that may be adjusted and managed to meet different characteristics that may accommodate the varying types of tennis players and the varying styles of play, skill level, and disabled players, and a ball collection portion.

BACKGROUND

When a tennis player uses a conventional tennis racket to strike a tennis ball, various results may occur depending on the four different areas on the racket face upon which the tennis ball is struck. A tennis racket face is a bed of tightly woven strings within the frame of the racket, upon which is used to strike a tennis ball.

The first area of a conventional tennis racket face is conventionally referred to as the "dead spot" area, which is generally located towards the tip of the racket, away from the handle of the racket. The dead spot on the tennis racket may typically be used by a tennis player during a serve (a serve is the start of a point in a tennis match where a player tosses a tennis ball into the air and hits the ball with the racket, usually at the highest point of the toss), as the maximum energy of the rotation of the swing is transferred to the tennis ball. Since the tip of the racket is moving faster than the rest of the racket, hitting the ball in the dead spot may result in an increased pace on a tennis serve, and thus many tennis players with strong serves may intentionally make contact in the dead spot when they are serving the ball.

The second, third, and fourth areas of the tennis racket are commonly referred to as "sweet spots," which produce the best combination of feel and power. The three sweet spots of the tennis racket are conventionally referred to as the Node of the First Harmonic area ("the Node area"), the Center of Percussion ("CoP"), and the "Power Zone" or "the zone of best bounce," respectively.

The second area of a conventional tennis racket face, or the Node of the First Harmonic area ("the Node area"), is generally located below the dead spot, toward the handle of the racket, which is the point on the string bed that produces the least amount of uncomfortable vibration on impact with the ball. Hitting the ball in the Node area may result in little vibration on groundstrokes (a groundstroke is a shot in tennis which is executed by hitting a tennis ball with the tennis racket after the ball bounces once on the court), but may offer less power than other areas of the racket face.

The third area of a conventional tennis racket face, the Center of Percussion ("CoP"), is generally located below the center of the conventional racket face, below the Node (toward the handle of the racket), is the area where the tennis ball will produce minimal initial shock to the tennis player's hand. Hitting the tennis ball in the CoP area may produce the most equalized and the most straight ball response from the racket.

The CoP may provide the best control or "feel" on groundstrokes, and also may provide the most stability and balance on a tennis stroke.

The fourth area of a conventional tennis racket face, the "Power Zone" or "zone of best bounce" is located just below the CoP, toward the handle of the racket. This is the area or zone with the greatest coefficient of restitution. The coefficient of restitution is the ratio of the incident speed of the tennis ball to the rebound speed of the tennis ball. The zone of best bounce affords the greatest transfer of power from the racket to the tennis ball. A tennis ball that is struck in the zone of best bounce may result in significant vibration on the racket, which thereby may give the tennis player less control on the racket. Tennis players who are adept at controlling their groundstrokes may intentionally hit the ball in the zone of best bounce.

The different results which occur when a tennis ball is struck by the different areas of a conventional tennis racket have been known to frustrate countless numbers of players, including beginners, advanced amateurs, and even professionals. Players may even reach the point of sometimes smashing their rackets in frustration when, although they have practiced diligently, they do not consistently get the same results for each time they strike the tennis ball with the conventional racket.

Several attempts have been made to increase and enlarge the different sweet spots in a tennis racket, including attempts to develop a tennis racket having a primarily rectangular shape. Other ideas include flattening the sides of the conventional oval racket such that the sides of the frame of the tennis racket are formed as straight sections. However, it may not be desirable to straighten the sides of the conventional racket because the oval shape may be a more aerodynamic shape for swinging as compared to a rectangle or non-oval shape racket. Furthermore, many tennis players prefer the overall feel and balance of the conventional oval shape racket over the rectangular or non-oval shape racket.

Another problem that is experienced by many tennis players is the need to pick up tennis balls from the ground. Currently, there is no practical or convenient way to assist a player to deal with the repetitive and hip and back bending motion needed to retrieve and lift the numerous types of tennis balls, in any condition, (e.g., new, used, damp, dry, clean, dirty, etc.) from the ground while learning or playing the game of tennis without the need for the player to bend over. Several attempts have been made to address this problem, including attaching a hooked fastening material (e.g., Velcro™) to the outer edge of the conventional tennis racket. However, this method requires that the tennis ball has a sufficient amount of fabric on the outer sphere in order for the hooked fastening material to grasp the ball. Often players may play with used or worn tennis balls that make it difficult to retrieve in this fashion, which may render the hooked fastening material less effective in retrieving the ball. Furthermore, the hooked fastening material may have difficulty retrieving a damp or wet tennis ball due to the additional weight of the moisture on the ball. Addressing this issue is extremely important, especially when a player's age, physical condition, or skill set (e.g., older tennis players, players who may be wheelchair bound, or tennis players with hip or back problems) does not include the ability to tap the ball repeatedly with the racket face and, "bounce" the ball to hand level or "cradle" the ball between the foot and racket head, while simultaneously lifting the foot and racket, (while still cradling the ball), and lifting the ball to hand level.

Therefore, a need exists in the art for a tennis racket that is capable of solving the problems of the conventional tennis racket as described above.

SUMMARY OF THE INVENTION

The above-described problems are addressed and a technical solution is achieved in the art by the tennis racket which alters the characteristics of the three different sweet spots (i.e., the Node, CoP, and zone of best bounce) and the dead spot. Such embodiment may manage these different areas of the face of the tennis racket by optimizing and enlarging the striking areas of the different sweet spots. An embodiment may accommodate the varying styles of play and various levels of tennis players, including players who are disabled, handicapped, or suffering from injuries due to the trauma from repeatedly hitting a tennis ball with a tennis racket. According to one or more embodiments of the present invention, this tennis racket also solves multiple issues associated with the modern day game of tennis, by assisting a tennis player with the mundane, repetitive hip and back bending motion needed to retrieve and lift the numerous balls from the ground while learning or playing the game of tennis. This may be realized by using a combination of the player's arm plus the length of the racket, in lieu of the hip and back bending motion and by utilizing the specialized U-shaped, ball retrieval opening in the frame of the tennis racket. The U-shaped ball retrieval opening in the frame also addresses the problem of the inconsistent tennis ball striking areas of the conventional tennis racket face by reducing the length of the longest vertical strings in the conventional tennis racket. The tennis racket is further enhanced with a movement towards the equalization in string length of all vertical & horizontal strings with addition of pairs of horizontal bars and vertical bars. In an example embodiment, the lengths of vertical and horizontal strings may change the characteristics of the tennis racket, e.g., maximize the striking areas or sweet spot areas of the tennis racket. The different combinations and variations of using the bars and the U-shapes indentation in the oval frame enable the various characteristics of the tennis racket performance.

BRIEF DESCRIPTION OF THE DRAWINGS

The present invention will be more readily understood from the detailed description of exemplary embodiments presented below considered in conjunction with the attached drawings, of which:

FIG. 2 is a close-up view of the U-shaped indentation in the frame of the tennis racket, according to an embodiment of the present invention;

FIG. 3 is a top view of the U-shaped indentation in the frame, according to an embodiment of the present invention;

It is to be understood that the attached drawings are for purposes of illustrating the concepts of the invention and may not be to scale, and are not intended to be limiting in terms of the range of possible shapes and/or proportions.

DETAILED DESCRIPTION OF THE INVENTION

For purposes of this specification, terms are to be given in their plain and ordinary meaning in the context in which they arise as understood by those possessing ordinary skill in the art.

Figure 1:
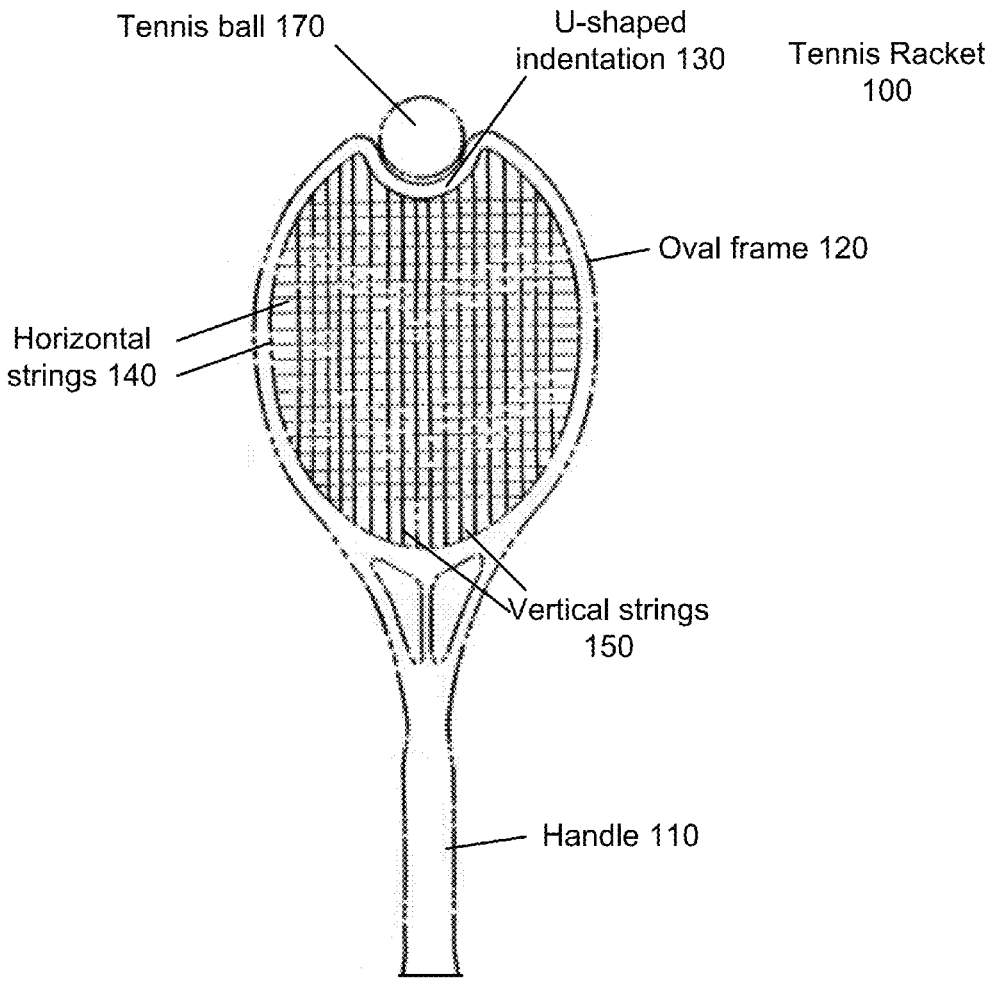
FIG. 1 is a profile view of a tennis racket having a U-shaped indentation in the frame and an optimized striking area, according to an embodiment of the present invention.

FIG. 1 illustrates an example embodiment of a tennis racket 100 having a U-shaped indentation 130 in the frame and an optimized striking area. As used herein, the term "U-shaped" is interpreted to mean being in the form of a "U". In an embodiment, the form of a "U" may take the shape of a semi-circle which may be suitably configured to conform to half of a tennis ball. In an embodiment, the U-shaped indentation 130 may have different depths of indentation. For example, in an embodiment, the U-shaped indentation 130 may be configured to accept and mate with a tennis ball 170. In an embodiment, the U-shaped indentation 130 may be a semi-circle in the form a half of a tennis ball. In another embodiment, the U-shaped indentation 130 may have a shallow curve with a minimum depth of indentation into the oval frame 120, relative to the configuration to mate with the tennis ball 170, while in another embodiment the U-shaped indentation 130 may be a steep curve with a large depth of indentation into the oval frame 120.

In an example embodiment, the tennis racket 100 as illustrated in FIG. 1 may include a handle 110 and an oval frame 120 attached to the handle 110. As used herein, the term "attached" is interpreted to mean fastened, affixed, joined, or connected. In an embodiment, the handle 110 may be attached to or integral with the oval frame 120. As used herein, the term "integral with" is interpreted to mean composed of parts that together constitute a whole. The oval frame 120 may comprise a U-shaped indentation 130. In an embodiment, the U-shaped indentation 130 may be located on the oval frame 120, distal to and substantially co-linear with the handle 110, as shown in FIG. 1. In an embodiment, the U-shaped indentation 130 may be located in other areas of the oval frame 120.

In an embodiment, the tennis racket 100 as shown in FIG. 1 includes a plurality of horizontal strings 140 and a plurality of vertical strings 150. Each of the plurality of horizontal strings 140 is substantially perpendicular to the orientation of the handle 110 and each of the plurality of vertical strings 150 is substantially parallel to the orientation of the handle 110.

In an embodiment, a portion of the vertical strings 150 are attached to the U-shaped indentation 130. In an embodiment, the length of the portion of the vertical strings 150 that are attached to the U-shaped indentation 130 may vary, depending on the depth of indentation of the U-shaped indentation 130. For example, in an embodiment, the U-shaped indentation 130 may have a steep curve with a relatively large depth of indentation into the oval frame 120. In this embodiment, the vertical strings 150 that are attached to the U-shaped indentation 130 may be relatively shorter than an embodiment where the U-shaped indentation 130 has a shallow curve with a minimum depth of indentation into the oval frame 120. Therefore, the depth of indentation of the U-shaped indentation 130 may vary the length of the vertical strings 150 that are attached to the U-shaped indentation 130.

In an embodiment, the depth of the U-shaped indentation may correlate with or affect the size and location of the different sweet spot areas and the dead spot of the tennis racket 100. This may be realized by varying the depth of the U-shaped indentation, which may vary the lengths of the vertical strings 150 that are attached to the U-shaped indentation 130. Such variance in the length of the vertical strings 150 may vary and adjust the respective sizes and locations of the different striking areas (e.g., the three sweet spot areas and the dead spot area) of the tennis racket 100. In an example embodiment, the reduction of the length of the vertical strings 150 that are attached to the U-shaped indentation 130 may enlarge the sweet spot areas (e.g., the Node, the CoP, or the zone of best bounce) and may relocate the sweet spot areas to closer to the center of the racket face, which may improve the overall hitting characteristics of the racket 100. In an embodiment, the hitting power of the racket 100 may be measured by its coefficient of restitution, which is an indication of the ability of the racket 100 to return the tennis ball 170 with a maximum force while losing a minimum amount of force in the exchange of the impact of the tennis ball 170 with the racket 100. In an embodiment, this configuration may simultaneously reduce the size of the dead spot area on the top of the tennis racket 100 for serving. In an embodiment, this configuration may be advantageous for novice or disabled tennis players. (Note: the suggestions throughout this specification of a certain characteristic or embodiment of tennis racket 100 as being suited for a certain type or level of tennis player are mentioned herein strictly for purposes of illustration and not limitation.).

FIG. 2 is a close-up view illustrating a tennis racket 100 having a U-shaped indentation 130 in the oval frame 120 with an attached adhesive layer 160, configured to accept and mate with a tennis ball 170. In an embodiment, the adhesive layer 160 may be adhesively attached to the U-shaped indentation 130. In an embodiment, the adhesive layer 160 may be Velcro™ or other similar material. In an embodiment, the adhesive layer 160 may be attached to a replaceable clip that may be attached to the oval frame 120 and suitably configured to retrieve a tennis ball 170. In an embodiment, the adhesive layer 160 may be configured to easily attach to the outer covering of the tennis ball 170. The outer covering of the tennis ball 170 is generally made of felt and/or other fibers. Thus, the tennis ball 170 may easily attach to the adhesive layer 160 on contact.

In an embodiment, the U-shaped indentation 130 may generally conform to the shape of a tennis ball 170. This configuration of the U-shaped indentation 130 may improve the ability to lift and retrieve a tennis ball 170 that may either be new, used, worn, damp, or wet by providing multiple points of contact between the surface area of the tennis ball 170 and the adhesive layer 160.

In an embodiment, the tennis racket 100 may not have the adhesive layer 160 attached to the substantially U-shaped inwardly curved indentation 130. In this example configuration, the size of the U-shaped inwardly curved indentation 130 may be configured to be slightly less than the diameter of the tennis ball 170, such that the tennis ball 170 may be retrieved when the tennis player grips the handle 110 of the tennis racket 100, positions the tennis racket 100 so that the U-shaped indentation 130 is over the tennis ball 170, and pushing the tennis racket 100 in a downward thrust motion over the tennis ball 170. The tennis ball 170 may be retrieved by utilizing the skin friction pressure coefficient created by the contact points of the U-shaped indentation 130 with the associated points of contact with the surface of the tennis ball 170.

FIG. 3 is a top view of the U-shaped indentation 130 in the frame 120 with the attached adhesive layer 160, according to an embodiment of the present invention. In an embodiment, the adhesive layer 160 may be a continuous strip that is attached to the U-shaped indentation 130. In an embodiment, multiple segments of the adhesive layer 160 may be strategically attached to the U-shaped indentation 130. In an embodiment, the adhesive layer 160 may be attached to the oval frame 120 and suitably configured to retrieve a tennis ball 170.

Figure 4:
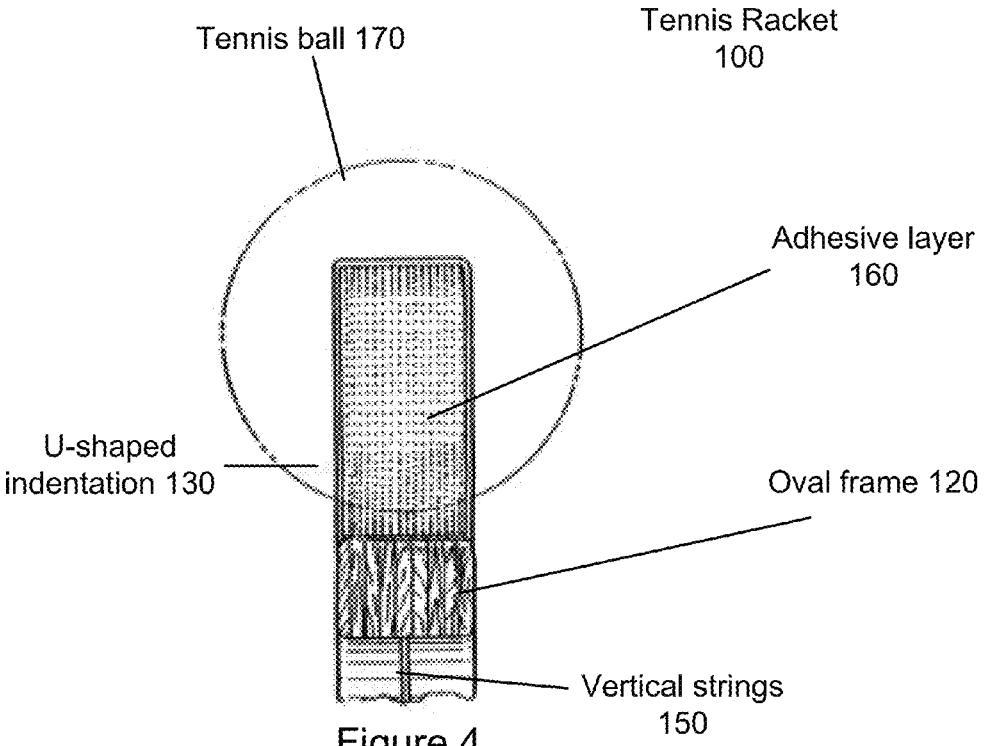
FIG. 4 is a cross-section, side view of the U-shaped indentation in the frame, according to an embodiment of the present invention.

FIG. 4 is a cross-section, side view of the U-shaped indentation 130 in the frame 120 with the attached adhesive layer 160 and the vertical strings 150, according to an embodiment of the present invention. In an embodiment, the U-shaped indentation 130 may be configured to mate with the tennis ball 170. In an embodiment, FIG. 4 illustrates the multiple points of contact between the tennis ball 170 and the adhesive layer 160.

Figure 5:
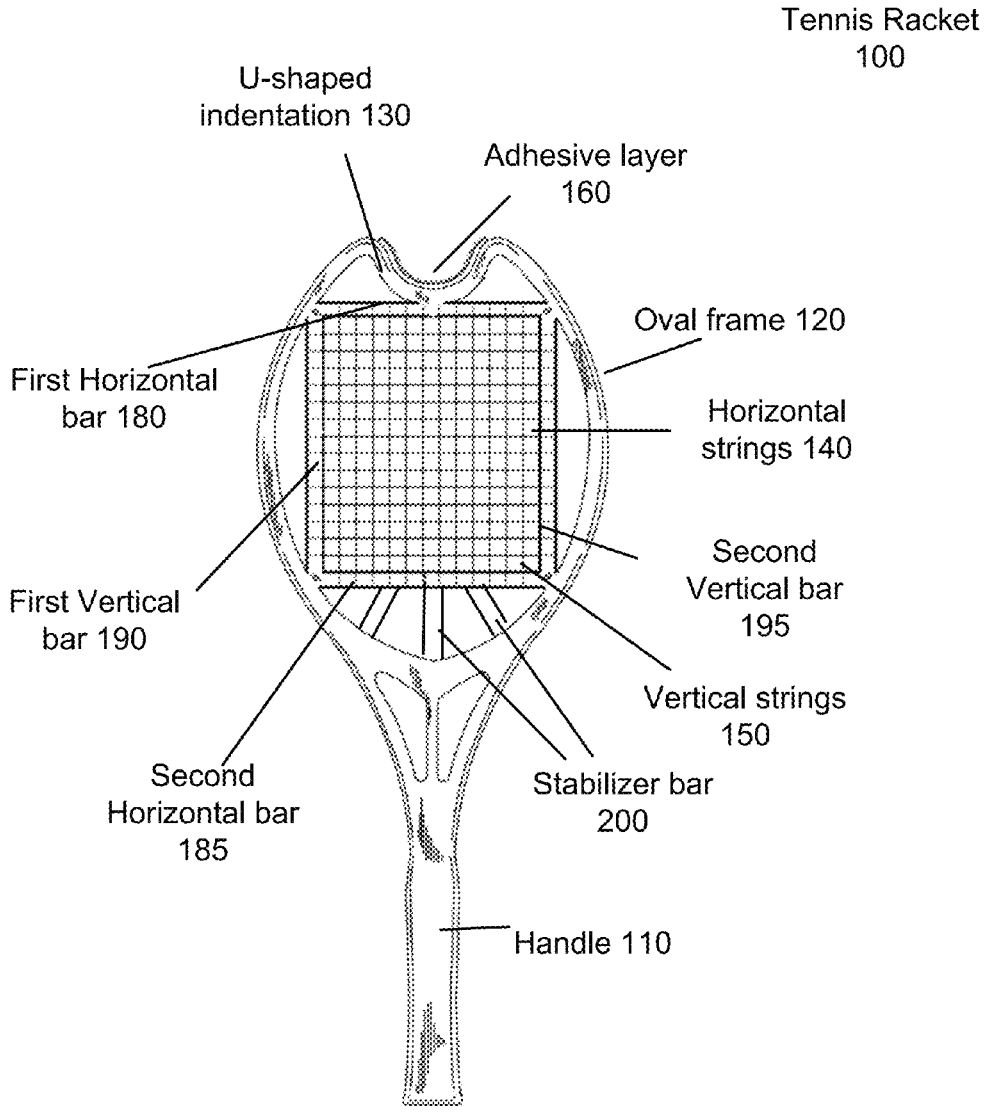
FIG. 5 is a profile view of a tennis racket having an optimized striking area and a ball collection portion, according to an embodiment of the present invention.

Referring to FIG. 5, in an example embodiment, the tennis racket 100 may include a first horizontal bar 180 attached to the oval frame 120. In an embodiment, the first horizontal bar 180 may be substantially perpendicular to the orientation of the handle 110. In an embodiment, the first horizontal bar 180 may be integral with the oval frame 120.

In an embodiment, the first horizontal bar 180 may be attached to an end of the oval frame 120 distal to the handle 110 and proximate to the U-shaped indentation 130. As shown in FIG. 5, a first end of each of the plurality of vertical strings 150 may be attached to the first horizontal bar 180 and a second end of each of the plurality of vertical strings 150 may be attached to the oval frame 120. In an embodiment, this configuration reduces the variability of the differing lengths of the vertical strings 150. In an example embodiment, the reduction of the variability of the differing lengths of the vertical strings 150 may further relocate and enlarge the different sweet spot areas to closer to the center of the racket face, which may improve the overall power of the racket and reduce the size of the dead spot area near the top of the racket for serving. In an embodiment, this configuration may this configuration may affect the size and location of the dead spot area and may be more advantageous for a novice or disabled tennis player in comparison with the example configuration of the tennis racket 100 without the attached first horizontal bar 180, as discussed above.

In an embodiment, the first horizontal bar 180 may be attached to an end of the oval frame 120 that is proximate to the handle 110 and distal to the U-shaped indentation 130, and wherein a first end of each of the plurality of vertical strings 150 may be attached to the first horizontal bar 180 bar and a second end of each of the plurality of vertical strings 150 may be attached to the U-shaped indentation 130. In an embodiment, this configuration may maintain the size and location of the dead spot area and may further reduce the variability of the differing lengths of the vertical strings 150. This configuration may also maintain the zone of best bounce area proximate to the handle.

In an example embodiment, the substantially equal lengths of each of the plurality of vertical strings 150 may result in the tennis racket 100 having the best balance of power and control for groundstrokes, while losing some power in the serve. This configuration may be a good option for a more experienced player and an elderly player who may need the convenience of picking up balls without having to bend down.

In an embodiment, a second horizontal bar 185 may be attached to an end of the oval frame 120 that is proximate to the handle 110. In an embodiment, the second horizontal bar 185 may be substantially parallel to the first horizontal bar 180, the first horizontal bar 180 may be attached to an end of the oval frame 120 that is proximate to the U-shaped indentation 130, and wherein a first end of each of the plurality of vertical strings 150 may be attached to the first horizontal bar 180 bar and a second end of each of the plurality of vertical strings 150 may be attached to the second horizontal bar 185. In an embodiment, the second horizontal bar 185 may be integral with the oval frame 120. In an embodiment, this configuration may even further reduce the variability of the differing lengths of the vertical strings 150 because each of the plurality of vertical strings 150 may have a substantially equal length.

In an example embodiment, this further reduction of the variability of the differing lengths of the vertical strings 150 may result in a tennis racket 100 with greater balance of power and control for groundstrokes, while maintaining power in the serve in comparison to the conventional tennis racket. This configuration may be a good option for more serious players and players who need the convenience of picking up balls, including senior or disabled players who experience trouble bending down to pick up the loose tennis balls.

In an embodiment, a first vertical bar 190 may be attached to the oval frame 120, wherein the first vertical bar 190 may be located proximate to a side edge of the oval frame 120. In an embodiment, the first vertical bar 190 may be integral with the oval frame 120. In an embodiment, the first vertical bar 190 may be substantially perpendicular to the first horizontal bar 180 and the second horizontal bar 185. In an embodiment, the first vertical bar 190 may be attached to an end of the first horizontal bar 180 and an end of the second horizontal bar 185. In an embodiment, a second vertical bar 195 may be attached to the oval frame 120, wherein the second vertical bar 195 may be located proximate to an opposite side edge of the oval frame 120. In an embodiment, the second vertical bar 195 may be integral with the oval frame 120. In an embodiment, the second vertical bar 195 may be substantially perpendicular to the first horizontal bar 180 and the second horizontal bar 185. In an embodiment, the second vertical bar 195 may be attached to an opposite end of the first horizontal bar 180 and to an opposite end of the second horizontal bar 185. In an embodiment, the first horizontal bar 180, the second horizontal bar 185, the first vertical bar 190, and the second vertical bar 195 may form a rectangle, as illustrated in FIG. 5.

In an embodiment, the tennis racket 100 further comprises a plurality of horizontal strings 140, wherein each of the plurality of horizontal strings 140 may have a substantially equal length. In an embodiment, each of the plurality of horizontal strings 140 may be substantially perpendicular to the first vertical bar 190 and the second vertical bar 195, and may be attached to the first vertical bar 190 and the second vertical bar 195. In an embodiment, this configuration may even further reduce the variability of the differing lengths of the horizontal strings 140 because each of the plurality of horizontal strings 140 may have a substantially equal length.

In an example embodiment, as shown in FIG. 5, the substantially equal lengths of each of the plurality of vertical strings 150 and the substantially equal lengths of each of the plurality of horizontal strings 140 may result in the tennis racket 100 having a relocated and an enlarged sweet spot area (e.g., an enlarged zone of best bounce, an enlarged CoP area, or an enlarged Node area) for ease of play. In an embodiment, the relocation and enlargement of the different sweet spot areas may result in the sweet spot areas overlapping each other. This embodiment of the tennis racket 100 may be better suited for a tennis player with, for example, a shoulder or an elbow issue, who can utilize the additional power that is generated by the racket configuration while minimizing negative effects which may occur from striking the tennis ball 170. This embodiment of the tennis racket 100 may also be well suited for a tennis player who needs the additional power and cannot bend down to pick up loose balls.

In an embodiment, the relocation and enlargement of the different sweet spot areas may enable the tennis player to use a tennis racket 100 that is configured to minimize the trauma to the player's elbow or shoulder. It is commonly understood that the string tension for most tennis rackets generally ranges from, for example, 58-68 pounds. It is also commonly understood that higher string tensions offer more control and better spin on the tennis ball 170, while lower string tensions offer more power and significantly less stress on the tennis player's elbow and shoulder. In an embodiment, the tennis racket 100 may have a string tension of greater than 68 pounds for greater control. In an embodiment, the enlarged sweet spot areas may mitigate the loss of control which may result when the tennis racket 100 has a string tension of less than 58 pounds. In an example embodiment, the string tension for the tennis racket 100 may be 35 pounds or lower while still enhancing the characteristics of the hitting areas. As such, the tennis racket 100 with a string tension of less than 58 pounds may reduce or minimize the trauma to the player's arm without sacrificing the level of control that typically results from such loose string tension.

In an example embodiment, the plurality of horizontal strings 140 and the plurality of vertical strings 150 may be substantially equal in length to each other. This configuration of the tennis racket 100 may be realized as the respective lengths of the first horizontal bar 180, the second horizontal bar 185, the first vertical bar 190, and the second vertical bar 195 moves towards being substantially equal.

In an embodiment, the tennis racket 100 may include one or more stabilization bars 200. In an embodiment, a first end of the stabilization bar 200 may attach to the oval frame 120 or to the U-shaped indentation 130 and a second end of the stabilization bar 200 may attach to the first horizontal bar 180, the second horizontal bar 185, the first vertical bar 190, or the second vertical bar 195. In an embodiment, the stabilization bar 200 may be integral with the oval frame 120 and the first horizontal bar 180, second horizontal bar 185, first vertical bar 190, or second vertical bar 195.

In an embodiment, the stabilization bar 200 may increase the performance of the tennis racket 100 by reducing the yaw bending motion which may be produced when the tennis racket 100 strikes a tennis ball 170. The yaw bending motion may occur when the tennis ball 170 strikes the face of the tennis racket 100 off-center, which may exert a torque or a twisting force upon the tennis racket 100. The stabilization bar 200 adds strength to certain areas of the tennis racket 100 to compensate for the twisting force or torque that may be applied to the tennis racket 100 during such off-center strikes.

In an embodiment, the stabilization bar 200 may lessen or reduce a tennis player's fear or belief that the tennis ball 170 might go through or be caught in the regions of space between the oval frame 120 and the first horizontal bar 180, second horizontal bar 185, first vertical bar 190, and second vertical bar 195.

Figure 6:
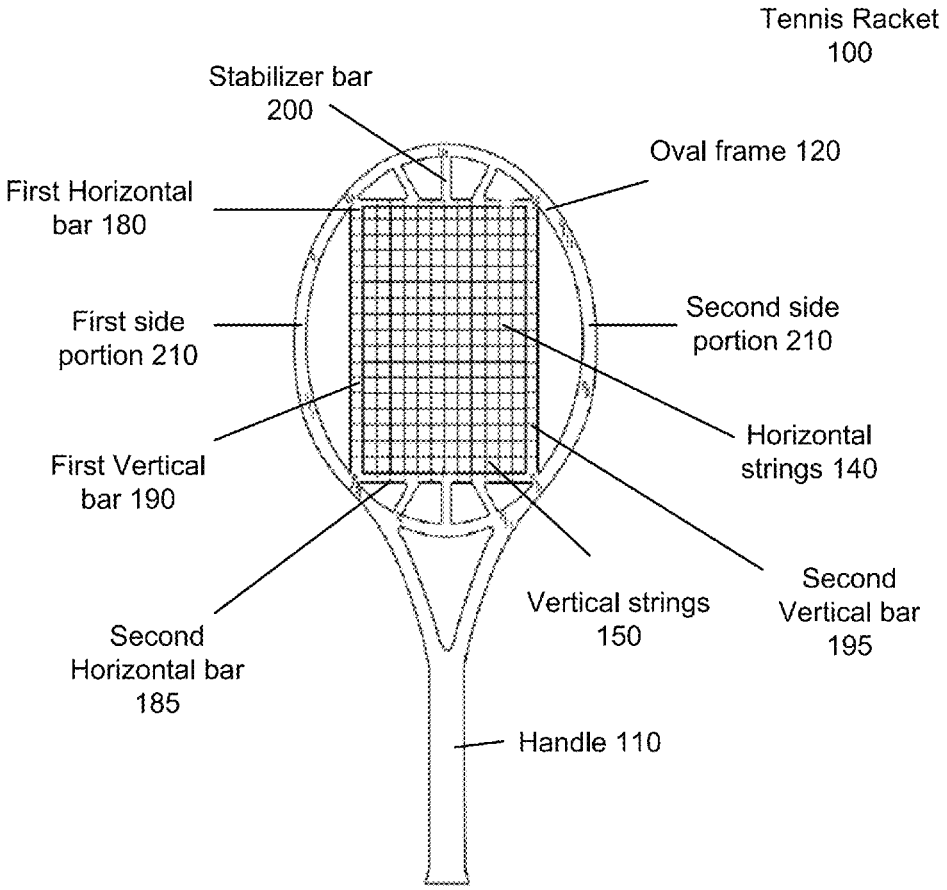
FIG. 6 is a profile view of a tennis racket having an optimized striking area, according to an embodiment of the present invention.

FIG. 6 is a profile view of a tennis racket 100 having an optimized striking area, according to an embodiment of the present invention. In an embodiment, the tennis racket 100 may include a handle 110 which may be attached to an oval frame 120 and the plurality of horizontal strings 140 and vertical strings 150. In an embodiment, the oval frame 120 may not include the U-shaped indentation 130 as described above in other embodiments of the tennis racket 100. In an embodiment, the tennis racket 100 may include a first horizontal bar 180, or a first horizontal bar 180 and a second horizontal bar 185, or a first vertical bar 190 and a second vertical bar 195, or any combination thereof, which may be attached to the oval frame 120. The addition of the first horizontal bar 180, second horizontal bar 185, first vertical bar 190, and second vertical bar 195 may result in the tennis racket 100 having similar properties as described in the embodiments of FIG. 5.

In an embodiment, the tennis racket 100 may include one or more stabilization bars 200. In an embodiment, a first end of the stabilization bar 200 may attach to the oval frame 120 and a second end of the stabilization bar 200 may attach to a first horizontal bar 180, a second horizontal bar 185, a first vertical bar 190, or a second vertical bar 195. In an embodiment, the stabilization bar 200 may be integral with the oval frame 120 and the first horizontal bar 180, second horizontal bar 185, first vertical bar 190, or second vertical bar 195.

Figure 7:
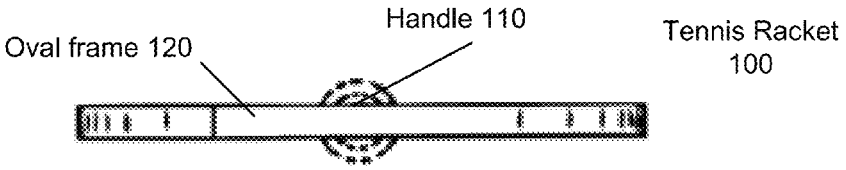
FIG. 7 is a top view of a tennis racket having an optimized striking area, according to an embodiment of the present invention.
Figure 8:
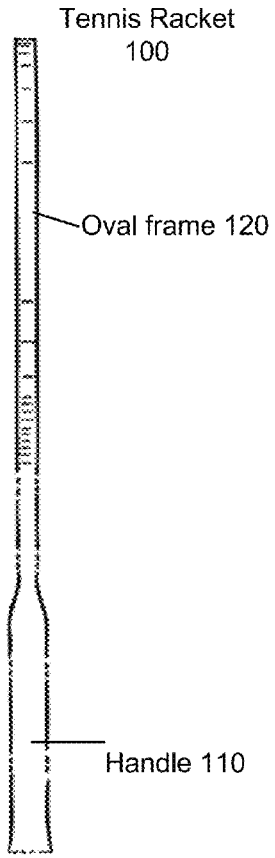
FIG. 8 is a side view of a tennis racket having an optimized striking area, according to an embodiment of the present invention.
Figure 9:
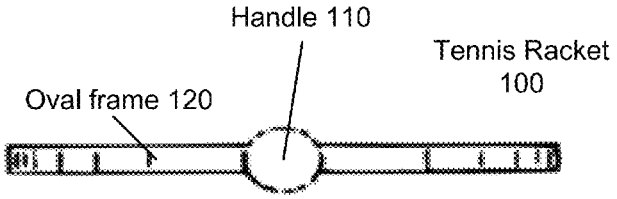
FIG. 9 is a bottom view of a tennis racket having an optimized striking area, according to an embodiment of the present invention.

FIGS. 7-9 is a top view, a side view, and a bottom view, respectively, of a tennis racket 100 having an optimized striking area, according to an embodiment of the present invention. These figures illustrate, for example, that in an embodiment, the first horizontal bar 180, second horizontal bar 185, first vertical bar 190, and second vertical bar 195, and the stabilization bar 200 may not outwardly protrude from the oval frame 120.

Figure 10:
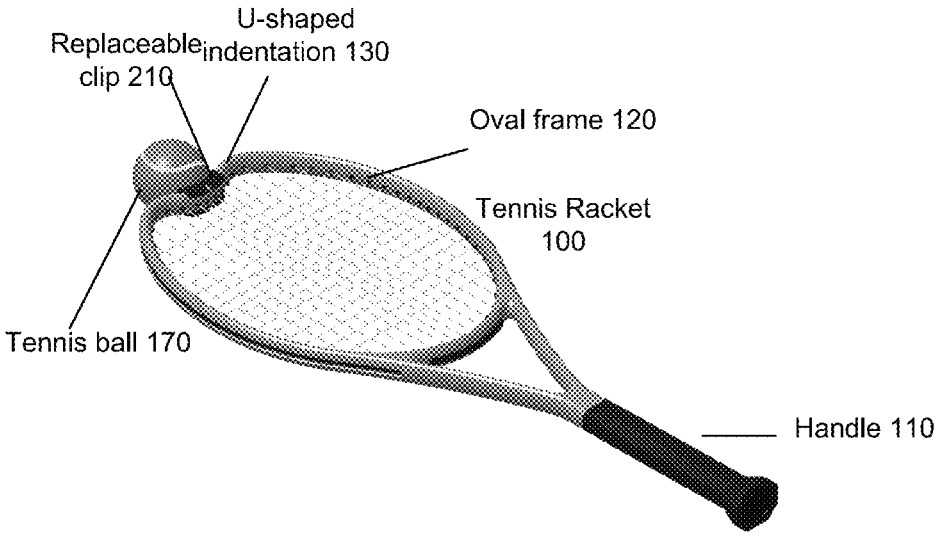
FIG. 10 is an illustration of a tennis racket having a U-shaped indentation in the frame and an optimized striking area, a replaceable clip, and an optimized striking area, according to an embodiment of the present invention.

FIG. 10 illustrates a tennis racket 100 having a handle 110, an oval frame 120, a U-shaped indentation 130, a replaceable clip 210 attached to the tennis racket 100, and a tennis ball 170. In an example embodiment, an adhesive layer 160 is not directly attached to the tennis racket 100, but instead may be attached to the replaceable clip 210, which is attached to the tennis racket 100. In an embodiment, the replaceable clip 210 may be configured to accept and mate with a tennis ball 170. In an embodiment, the replaceable clip 210 may be configured to easily attach to and detach from different areas of the tennis racket 100, including any area on the oval frame 120, the U-shaped indentation 130, or the handle 110. In an example embodiment, the adhesive layer 160 may be configured to easily attach to and detach from the replaceable clip 210. In an embodiment, the replaceable clip 210 may substantially conform to the shape of the U-shaped indentation 130, any specific portion of the oval frame 120, or to the handle 110.

Figure 11:
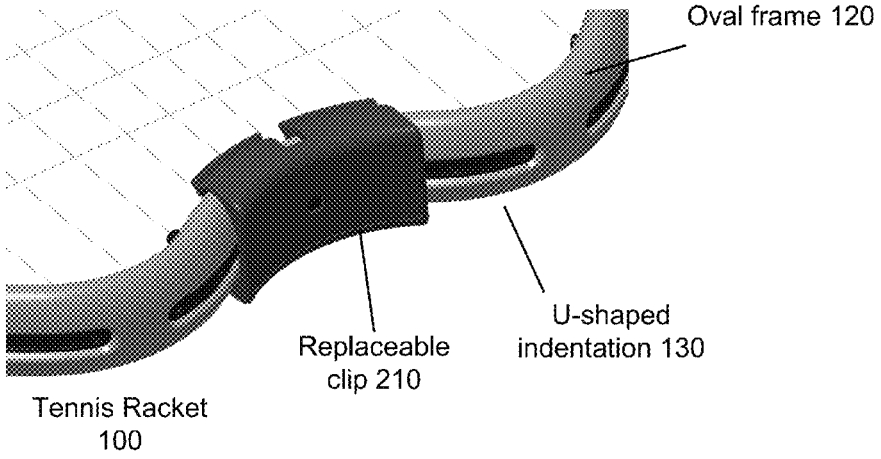
FIG. 11 is an illustration of a close-up view of a tennis racket having a U-shaped indentation in the frame and a replaceable clip, according to an embodiment of the present invention.

FIG. 11 illustrates a close-up view of the tennis racket 120 having an oval frame 120, a U-shaped indentation 130, and a replaceable clip 210 attached to the tennis racket 100.

Figure 12:
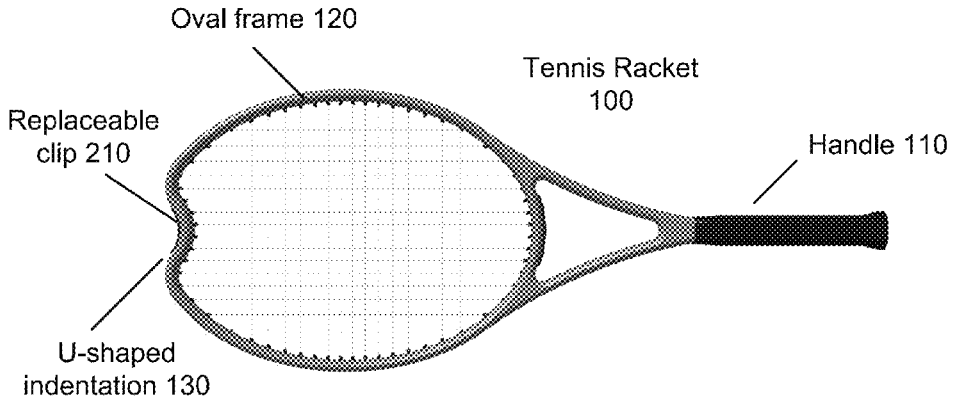
FIG. 12 is an illustration of a tennis racket having a U-shaped indentation in the frame and an optimized striking area, a replaceable clip, and an optimized striking area, according to an embodiment of the present invention.

FIG. 12 illustrates a tennis racket 100 having a handle 110, an oval frame 120, a U-shaped indentation 130, and a replaceable clip 210 attached to the tennis racket 100.

Figure 13:
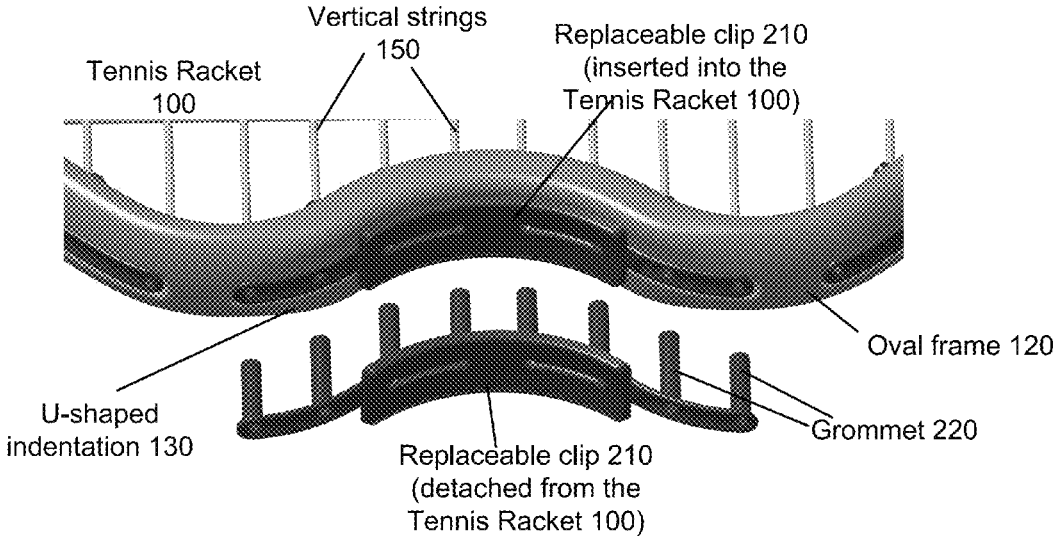
FIG. 13 is an illustration of a close-up view of a tennis racket having a U-shaped indentation in the frame and a replaceable clip, according to an embodiment of the present invention.

FIG. 13 illustrates a close-up view of the tennis racket 100 with the replaceable clip 210 inserted into the tennis racket 100 and also an illustration of the replaceable clip 210 detached from the tennis racket 100. In an embodiment, the replacement clip 210 may be embedded within a set of grommets 220. In an embodiment, the grommets 220 may be configured to slide into the oval frame 120. In an embodiment, the replaceable clip 210 may be attached to tennis racket 100 by threading the vertical strings 150 through the grommets 220.

One having ordinary skill in the art will appreciate that the size, shape and placement of such structures may be varied depending on the particular application. Apart from the functional aspects the structures provide, they also provide a novel decorative element. One having ordinary skill in the art will appreciate the decorative possibilities such shapes present.

The foregoing description, for purposes of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the invention and its practical applications, to thereby enable others skilled in the art to best utilize the invention and various embodiments with various modifications as may be suited to the particular use contemplated.

What is claimed is:

1. A tennis racket comprising:

a handle;

an oval frame attached to the handle, the oval frame comprising a U-shaped indentation;

a plurality of vertical strings attached to the oval frame, wherein each of the plurality of vertical strings is substantially parallel to the handle, and wherein a first end of each of the plurality of vertical strings is attached to a first end portion of the oval frame distal to the handle and a second end of each of the plurality of vertical strings is attached to a second end portion of the oval frame proximate to the handle;

a plurality of horizontal strings attached to the oval frame, wherein each of the plurality of horizontal strings is substantially perpendicular to the handle, and wherein a first end of each of the plurality of horizontal strings is attached to a first side portion of the oval frame and a second end of each of the plurality of horizontal strings is attached to a second side portion of the oval frame;

and a replaceable clip sized to be attached within the U-Shaped indentation of the tennis racket wherein the plurality of vertical and horizontal strings form a sweet spot area, the sweet spot area having a size, and wherein a depth of the U-shaped indentation affects the size of the sweet spot area;

the tennis racket further comprising a first horizontal bar integrally attached to the oval frame, wherein the first horizontal bar is substantially perpendicular to the handle, and wherein the first horizontal bar is attached to the U-shaped indentation.

2. The tennis racket of claim 1, further comprising an adhesive layer attached to the replaceable clip.

3. The tennis racket of claim 1, wherein the replaceable clip is embedded within a set of grommets.

4. The tennis racket of claim 1, wherein the first horizontal bar is integrally attached to an end of the oval frame distal to the handle.

5. The tennis racket of claim 4, further comprising a second horizontal bar attached to an end of the oval frame proximate to the handle, wherein:

the second horizontal bar is substantially parallel to the first horizontal bar, and the first end of each of the plurality of vertical strings is attached to the first horizontal bar and the second end of each of the plurality of vertical strings is attached to the second horizontal bar.

6. A tennis racket comprising:

a handle;

an oval frame attached to the handle, the oval frame comprising a U-shaped indentation;

a plurality of vertical strings attached to the oval frame, wherein each of the plurality of vertical strings is substantially parallel to the handle, and wherein a first end of each of the plurality of vertical strings is attached to a first end portion of the oval frame distal to the handle and a second end of each of the plurality of vertical strings is attached to a second end portion of the oval frame proximate to the handle;

a plurality of horizontal strings attached to the oval frame, wherein each of the plurality of horizontal strings is substantially perpendicular to the handle, and wherein a first end of each of the plurality of horizontal strings is attached to a first side portion of the oval frame and a second end of each of the plurality of horizontal strings is attached to a second side portion of the oval frame;

and a replaceable clip sized to be attached within the U-Shaped indentation of the tennis racket wherein the plurality of vertical and horizontal strings form a sweet spot area, the sweet spot area having a size, and wherein a depth of the U-shaped indentation affects the size of the sweet spot area;

the tennis racket further comprising a first horizontal bar integrally attached to the oval frame, wherein the first horizontal bar is substantially perpendicular to the handle;

the tennis racket further comprising:

a first vertical bar integrally attached to the oval frame, wherein the first vertical bar is located proximate to a first side portion of the oval frame, the first vertical bar is substantially perpendicular to the first horizontal bar and the first vertical bar is integrally attached to an end of the first horizontal bar; and a second vertical bar integrally attached to the oval frame, wherein the second vertical bar is located proximate to a second side portion of the oval frame, the second vertical bar is substantially perpendicular to the first bar and the second vertical bar is integrally attached to an opposite end of the first horizontal bar.

7. The tennis racket of claim 6, further comprising a second horizontal bar attached to an end of the oval frame proximate to the handle, wherein the first horizontal bar, the second horizontal bar, the first vertical bar, and the second vertical bar form a rectangular shape.

8. The tennis racket of claim 7, further comprising a stabilizer bar, wherein a first end of the stabilizer bar is attached to the oval frame and a second end of the stabilizer bar is attached to one of the first horizontal bar, the second horizontal bar, the first vertical bar, or the second vertical bar.

9. The tennis racket of claim 7, wherein the first end of each of the plurality of horizontal strings is attached to the first vertical bar and the second end of each of the plurality of horizontal strings is attached to the second vertical bar.

10. The tennis racket of claim 9, wherein each of the plurality of horizontal strings and each of the plurality of vertical strings have a string tension which is extended to be either less than 58 pounds or greater than 68 pounds.

11. A tennis racket comprising:

a handle;

an oval frame attached to the handle; and a first horizontal bar integrally attached to the oval frame, wherein the first horizontal bar is substantially perpendicular to the handle;

the tennis racket further comprising a plurality of vertical strings attached to the oval frame and to the first horizontal bar, wherein the first horizontal bar is integrally attached to an end of the oval frame distal to the handle, wherein the plurality of vertical strings are substantially parallel to the handle and wherein a first end of each of the plurality of vertical strings is attached to the first horizontal bar and a second end of each of the plurality of vertical strings is attached to the oval frame, the tennis racket further comprising:

a first vertical bar integrally attached to the oval frame, wherein the first vertical bar is located proximate to a first side portion of the oval frame, the first vertical bar is substantially perpendicular to the first horizontal bar and the first vertical bar is integrally attached to an end of the first horizontal bar; and a second vertical bar integrally attached to the oval frame, wherein the second vertical bar is located proximate to a second side portion of the oval frame, the second vertical bar is substantially perpendicular to the first horizontal bar and the second vertical bar is integrally attached to an opposite end of the first horizontal bar.

12. The tennis racket of claim 11, further comprising a second horizontal bar attached to an end of the oval frame proximate to the handle, wherein:

the second horizontal bar is substantially parallel to the first horizontal bar, and a first end of each of the plurality of vertical strings is attached to the first horizontal bar and a second end of each of the plurality of vertical strings is attached to the second horizontal bar.

13. The tennis racket of claim 11, further comprising a second horizontal bar integrally attached to an end of the oval frame proximate to the handle, wherein the first horizontal bar, the second horizontal bar, the first vertical bar, and the second vertical bar form a rectangular shape.

14. The tennis racket of claim 13, further comprising a stabilizer bar, wherein a first end of the stabilizer bar is attached to the oval frame and a second end of the stabilizer bar is attached to one of the first horizontal bar, the second horizontal bar, the first vertical bar, or the second vertical bar.

15. The tennis racket of claim 13, further comprising a plurality of horizontal strings, wherein each of the plurality of horizontal strings is substantially perpendicular to the first and second vertical bars, wherein a first end of each of the plurality of horizontal strings is attached to the first vertical bar and a second end of each of the plurality of horizontal strings is attached to the second vertical bar.

16. The tennis racket of claim 15, wherein each of the plurality of horizontal strings and each of the plurality of vertical strings have a string tension which is extended to be either less than 58 pounds or greater than 68 pounds.

* * * * *